US008680962B2

(12) United States Patent
Goto et al.

(10) Patent No.: US 8,680,962 B2
(45) Date of Patent: Mar. 25, 2014

(54) TRANSFORMER INCORPORATED IN ELECTRONIC CIRCUITS

(71) Applicants: Nippon Soken, Inc., Nishio (JP); Denso Corporation, Kariya (JP)

(72) Inventors: Tomoyuki Goto, Anjo (JP); Masanori Yasuda, Okazaki (JP); Hisanaga Matsuoka, Okazaki (JP); Yuuki Takemoto, Kariya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 13/721,305

(22) Filed: Dec. 20, 2012

(65) Prior Publication Data

US 2013/0106551 A1 May 2, 2013

Related U.S. Application Data

(62) Division of application No. 13/325,383, filed on Dec. 14, 2011.

(30) Foreign Application Priority Data

Dec. 14, 2010 (JP) ..... 2010-277986

(51) Int. Cl.

| | |
|---|---|
| ***H01F 27/24*** | (2006.01) |
| ***H01F 27/02*** | (2006.01) |
| ***H01F 27/30*** | (2006.01) |
| ***H01F 27/29*** | (2006.01) |

(52) U.S. Cl.

USPC ..... 336/212; 336/83; 336/90; 336/92; 336/96; 336/192; 336/198

(58) Field of Classification Search

USPC ..... 336/212, 214, 221, 199, 178, 105, 100

See application file for complete search history.

(56) References Cited

U.S. PATENT DOCUMENTS

| | | | | |
|---|---|---|---|---|
| 4,047,138 | A * | 9/1977 | Steigerwald | 336/100 |
| 6,114,934 | A * | 9/2000 | Ikeda et al. | 336/100 |

(Continued)

FOREIGN PATENT DOCUMENTS

| | | |
|---|---|---|
| JP | 61-292806 | 12/1986 |
| JP | 09-017655 | 1/1997 |

(Continued)

OTHER PUBLICATIONS

Office Action (2 pages) dated Dec. 4, 2013 issued in corresponding Japanese Application No. 2010-277986 and English translation (2 pages).

*Primary Examiner* — Elvin G Enad
*Assistant Examiner* — Kazi Hossain
(74) *Attorney, Agent, or Firm* — Nixon & Vanderhye, P.C.

(57) ABSTRACT

A vibration-suppressed transformer is fixed to a base plate and includes a magnetic lower core, two or more magnetic upper cores, primary and secondary coils. The lower core is on the base plate. The upper cores are arranged face to face over the lower core. The coils are arranged between the lower and upper cores. Each upper core contacts the lower core, on an outer side of the coils, with a first gap being provided between the upper and lower cores, on an inner side of the coils. The upper cores are extended towards each other from the outer to the inner side of the coils, with a second gap being provided therebetween. The second gap is provided therein with a non-magnetic pressing member to press the lower core against the base plate, on an inner side of the coils.

11 Claims, 9 Drawing Sheets

(56) References Cited

U.S. PATENT DOCUMENTS

| | | | | |
|---|---|---|---|---|
| 6,512,438 | B1 | 1/2003 | Yoshimori et al. | |
| 7,109,837 | B2 * | 9/2006 | Watts et al. | 336/178 |
| 2005/0047175 | A1 * | 3/2005 | Kawasaki et al. | 363/16 |
| 2006/0066433 | A1 * | 3/2006 | Decristofaro et al. | 336/212 |
| 2008/0030293 | A1 | 2/2008 | Kawasaki et al. | |
| 2008/0212341 | A1 * | 9/2008 | Moiseev | 363/21.04 |
| 2009/0290388 | A1 | 11/2009 | Kawasaki et al. | |
| 2012/0146758 | A1 | 6/2012 | Goto et al. | |

FOREIGN PATENT DOCUMENTS

| | | |
|---|---|---|
| JP | 11-233348 | 8/1999 |
| JP | 2005-051995 | 2/2005 |
| JP | 2006-066683 | 3/2006 |
| JP | P4446473 | 1/2010 |
| JP | 2010-118496 | 5/2010 |

* cited by examiner

TRANSFORMER INCORPORATED IN ELECTRONIC CIRCUITS

CROSS-REFERENCE TO RELATED APPLICATION

This application is a Division of application Ser. No. 13/325,383, filed Dec. 14, 2011, which is based on and claims the benefit of priority from earlier Japanese Patent Application No. 2010-277986 filed Dec. 14, 2010, the disclosures of each of which are incorporated herein by reference.

BACKGROUND

1. Technical Field

The disclosure relates to a transformer incorporated in electronic circuits such as DC-DC converters.

2. Related Art

Some DC-DC converters use transformers to perform voltage conversion of DC power. One of such DC-DC converters is shown in FIGS. 1A, 1B and 2. FIG. 1A is a plan view illustrating a transformer based on conventional art. FIG. 1B is a cross-sectional view taken along a line A-A of FIG. 1A. FIG. 2 is an explanatory view illustrating vibration of the transformer based on conventional art.

As shown in FIG. 1B, a transformer 9 is fixed to a base plate 6 that is a metal plate made of aluminum or the like. The transformer 9 includes a lower core 2, at least two upper cores 3, primary coils 41 and a secondary coil 42. The lower core 2 is made of a magnetic material and arranged on the base plate 6. The two upper cores 3 are arranged face to face over the upper surface of the lower core 2. The primary coils 41 and the secondary coil 42 are arranged between the lower core 2 and the upper cores 3 (e.g., see JP-A-2005-051995).

Each upper core 3 is in contact with the lower core 2 on the outer side of the primary coils 41 and the secondary coil 42. Also, a first gap 11 is formed between each upper core 3 and the lower core 2, on the inner side of the primary coils 41 and the secondary coil 42. Further, the two upper cores 3 are extended towards each other, i.e. extended from the outer side of the primary coils 41 and the secondary coil 42 toward the inner side of these coils, with a second gap 12 being provided between opposing surfaces of the upper cores 3.

Thus, a magnetic path that passes the inner side and the outer side of the primary coils 41 and the secondary coil 42 is formed by the lower core 2 and the upper cores 3, while the occurrence of magnetic saturation is prevented by the first gaps 11.

However, in the transformer 9, ripple current is caused due to the presence of the first gap 11. The ripple current may pass through the primary coils 41, as shown in FIG. 2, and cause fluctuations in the magnetic flux $\phi$. In such a case, a magnetic attractive force F is generated in the first gap 11, by which the lower core 2 and the upper core 3 are attracted to each other, and at the same time, the magnitude of the magnetic attractive force F is varied. Accordingly, in each first gap 11, the upper core 3 and the lower core 2 vibrate such that these cores 3 and 2 mutually come closer and are mutually drawn apart (see the arrow V of FIG. 2), causing noise (vibration noise). In other words, the vibration of the cores 3 and 2 is transmitted to the vehicle cabin, for example, of the vehicle that installs the DC-DC converter, and generates noise.

SUMMARY

Under the conditions as set forth above, it is thus desired to provide a transformer in which vibration is suppressed.

In order to solve the problem set forth above, the transformer of an exemplary embodiment has a first aspect in which the transformer includes a lower core, at least two upper cores, primary coils and a secondary coil. The lower core is made of a magnetic material, has a lower surface and an upper surface and is arranged on a base plate through the lower surface. The two upper cores are made of a magnetic material and arranged face to face over the upper surface of the lower core, the upper surface of the lower core being on the other side of the lower surface of the lower core through which the lower core is arranged on the base plate. The primary coils and the secondary coil are arranged between the lower core and the upper cores. The transformer is fixed to the base plate.

Each of the two upper cores is in contact with the lower core, on an outer side of the primary coils and the secondary coil, with a first gap being provided between the upper core and the lower core, on an inner side of the primary coils and the secondary coil.

The two upper cores are each extended, from the outer side to the inner side of the primary coils and the secondary coil, towards each other, with a second gap being provided between opposing surfaces of the two upper cores.

A spacer made of a non-magnetic material is provided in each of the first gaps.

In the configuration mentioned above, the transformer has the first gaps in which the respective spacers are provided. Thus, when magnetic attractive force is caused between the upper core and the lower core, each spacer is able to prevent the upper core and the lower core from displacing in the direction along which the upper and lower cores come close to each other. As a result, vibration of the upper cores and the lower core is suppressed to thereby suppress the vibration noise of the transformer.

Also, the spacers are made of a non-magnetic material. Therefore, the spacers, being arranged in the respective first gaps, will not deteriorate the magnetic effects exerted by the first gaps and thus will not affect the magnetic flux formed in the upper cores and the lower core. In other words, the above configuration effectively suppresses the vibration of the transformer without adversely affecting the magnetic flux formed in the upper cores and the lower core.

Thus, with the above configuration, a transformer having less vibration can be provided.

In order to solve the problem set forth above, the transformer of the exemplary embodiment has a first aspect in which the transformer includes a lower core, at least two upper cores, primary coils and a secondary coil. The lower core is made of a magnetic material, has a lower surface and an upper surface and is arranged on a base plate through the lower surface. The two upper cores are made of a magnetic material and arranged face to face over the upper surface of the lower core, the upper surface of the lower core being on the other side of the lower surface of the lower core through which the lower core is arranged on the base plate. The primary coils and the secondary coil are arranged between the lower core and the upper cores. The transformer is fixed to the base plate.

Each of the two upper cores is in contact with the lower core, on an outer side of the primary coils and the secondary coil, with a first gap being provided between the upper core and the lower core, on an inner side of the primary coils and the secondary coil.

The two upper cores are each extended from the outer side to the inner side of the primary coils and the secondary coil, in a direction of coming close to each other, with a second gap being provided between opposing surfaces of the two upper cores.

The second gap is provided therein with a pressing member made of a non-magnetic material to press the lower core against the base plate, on an inner side of the primary coils and the secondary coil.

According to the above configuration, the transformer includes the pressing member made of a non-magnetic material, which is located in the second gap on an inner side of the primary coils and the secondary coil to press the lower core against the base plate. Thus, through the portion of the lower core in communication with the second gap, the lower core is pressed against the base plate to thereby suppress the vibration of the lower core. Specifically, in portions of the first gaps, in particular, between the lower core and the respective upper cores, which portions are near the second gap, a large magnetic attractive force is easily caused and the amplitude of the vibration tends to be large. In this regard, using the pressing member, the lower core is pressed against the base plate in these portions to thereby suppress the vibration of the lower core. As a result, the vibration noise of the transformer is suppressed.

Further, being made of a non-magnetic material, the pressing member, when it is arranged in the second gap, will not deteriorate the magnetic effect of the second gap and thus will not adversely affect the magnetic flux formed in the upper cores and the lower core. In other words, the above configuration effectively suppresses the vibration of the transformer without adversely affecting the magnetic flux formed in the upper cores and the lower core.

Thus, according to the above configuration, a transformer suppressed with vibration is provided.

In order to solve the problem set forth above, the transformer of the exemplary embodiment has a first aspect in which the transformer includes a lower core, at least two upper cores, primary coils and a secondary coil. The lower core is made of a magnetic material, has a lower surface and an upper surface and is arranged on a base plate through the lower surface. The two upper cores are made of a magnetic material and arranged face to face over the upper surface of the lower core, the upper surface of the lower core being on the other side of the lower surface of the lower core through which the lower core is arranged on the base plate. The primary coils and the secondary coil are arranged between the lower core and the upper cores. The transformer is fixed to the base plate.

Each of the two upper cores is in contact with the lower core, on an outer side of the primary coils and the secondary coil, with a first gap being provided between the upper core and the lower core, on an inner side of the primary coils and the secondary coil.

The two upper cores are each extended from the outer side to the inner side of the primary coils and the secondary coil, in a direction of coming close to each other, with a second gap being provided between opposing surfaces of the two upper cores.

A spacer made of a non-magnetic material is provided in each of the first gaps.

The second gap is provided therein with a pressing member made of a non-magnetic material to press the lower core against the base plate, on an inner side of the primary coils and the secondary coil.

With the above configuration, while the vibration of the lower core is reliably suppressed, the relative vibration between the lower core and the upper cores is also suppressed. Thus, the vibration of the transformer is more effectively suppressed by the synergistic effect of the spacers and the pressing member.

In the first or second aspect set forth above, it is preferable that the base plate is made of non-magnetic metal, such as aluminum. In this case, heat of the transformer is effectively discharged.

Also, one primary coil and one secondary coil may be provided, or two or more primary coils and two or more secondary coils may be provided.

The spacer and the pressing member may preferably be made of a ceramic, a resin or the like. The spacer may preferably be fixed to the lower core and the upper cores by bonding or the like.

In the first aspect set forth above, it is preferable that the spacer is also extended into the second gap. In this case, positioning of the spacer is facilitated to thereby reliably and easily allow the spacer to exert the effect of suppressing the vibration.

In the first or second aspect set forth above, it is preferable that the lower surface of the lower core facing the base plate includes a non-contact surface not contacting the base plate, and that the non-contact surface has an area occupying not less than a half of the area of the lower surface.

In this case, the vibration of the transformer is prevented from being transmitted via the base plate. Specifically, in spite of providing the spacer or the pressing member, it is sometimes difficult to completely prevent the vibration of the transformer. In this regard, the non-contact surface of the lower core is able to reduce the contact area between the transformer and the base plate. Accordingly, the vibration of the transformer is suppressed from being transmitted to the base plate. For example, in a vehicle installing the transformer, the vibration noise is effectively suppressed from being transmitted to the vehicle cabin.

Further, it is preferable that a vibration absorber is interposed between the lower core and the base plate. In this case, the vibration absorber absorbs the vibration of the lower core to suppress the vibration of the lower core. Also, being interposed between the lower core and the base plate, the vibration absorber is able to suppress the vibration of the transformer from being transmitted to the base plate. As a result, in a vehicle, for example, installing the transformer, the vibration noise is effectively suppressed from being transmitted to the vehicle cabin.

It is preferable that, in the lower surface of the lower core, the area for arranging the vibration absorber occupies not less than a half of the area of the lower surface. The vibration absorber may be made of grease or the like.

DETAILED DESCRIPTION OF THE PREFERRED EMBODIMENTS

First Embodiment

With reference to the accompanying drawings, hereinafter are described several embodiments of a transformer according the present invention.

Figure 1A:
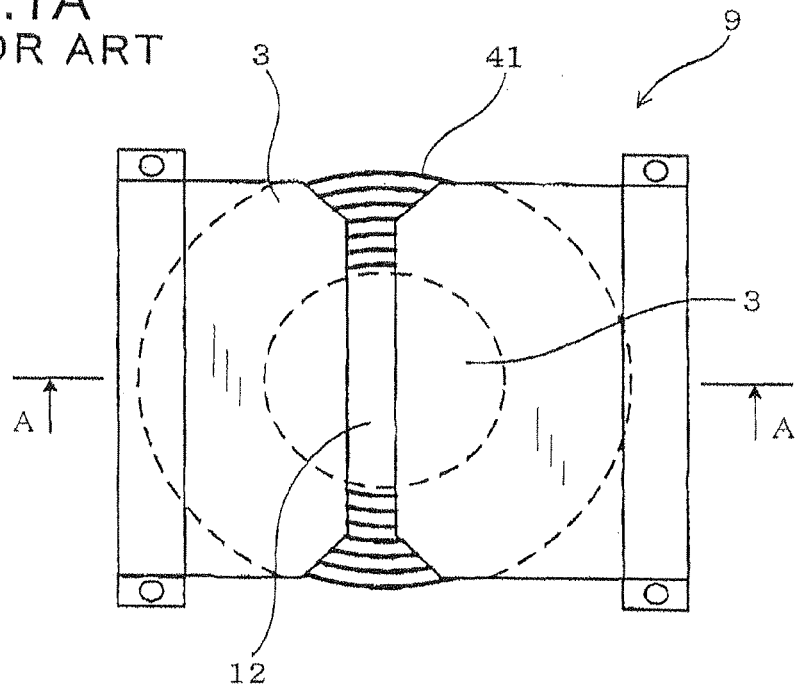
FIG.1A PRIOR ART
FIG. 1A is a plan view illustrating a transformer based on conventional art.
Figure 1B:
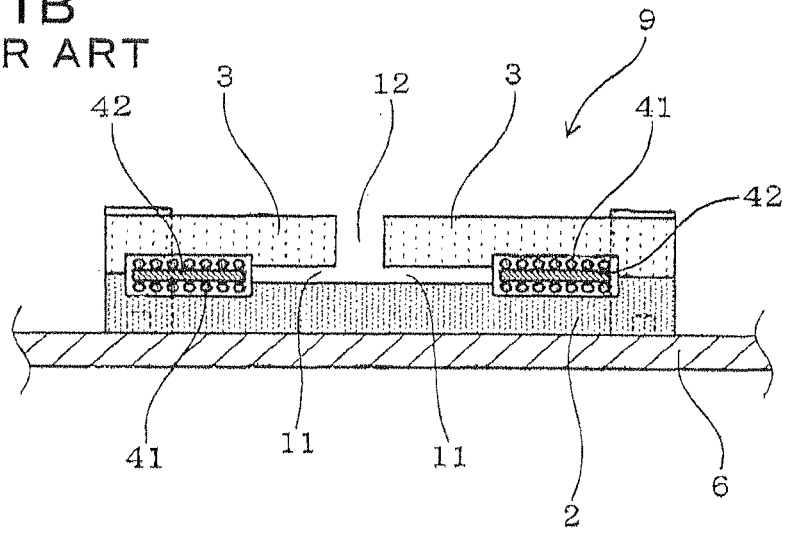
FIG.1B PRIOR ART
FIG. 1B is a cross-sectional view taken along a line A-A of FIG. 1A.
Figure 2:
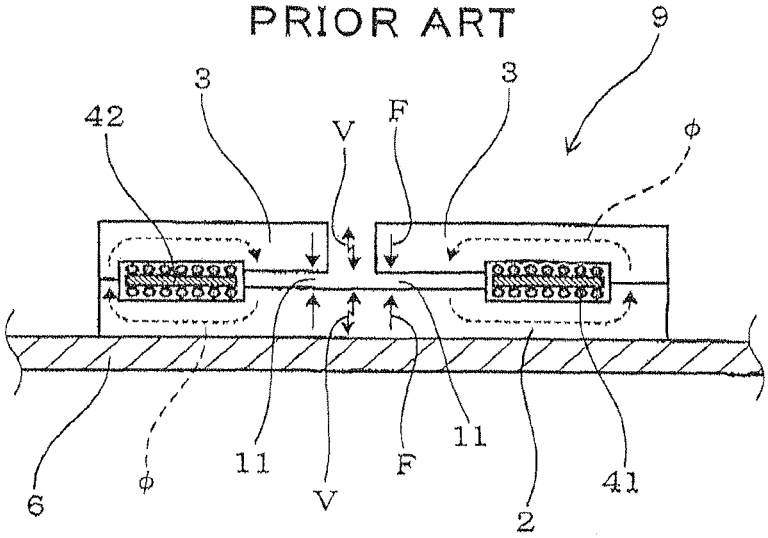
FIG.2 PRIOR ART
FIG. 2 is an explanatory view illustrating vibration of the transformer based on conventional art.
Figure 3A:
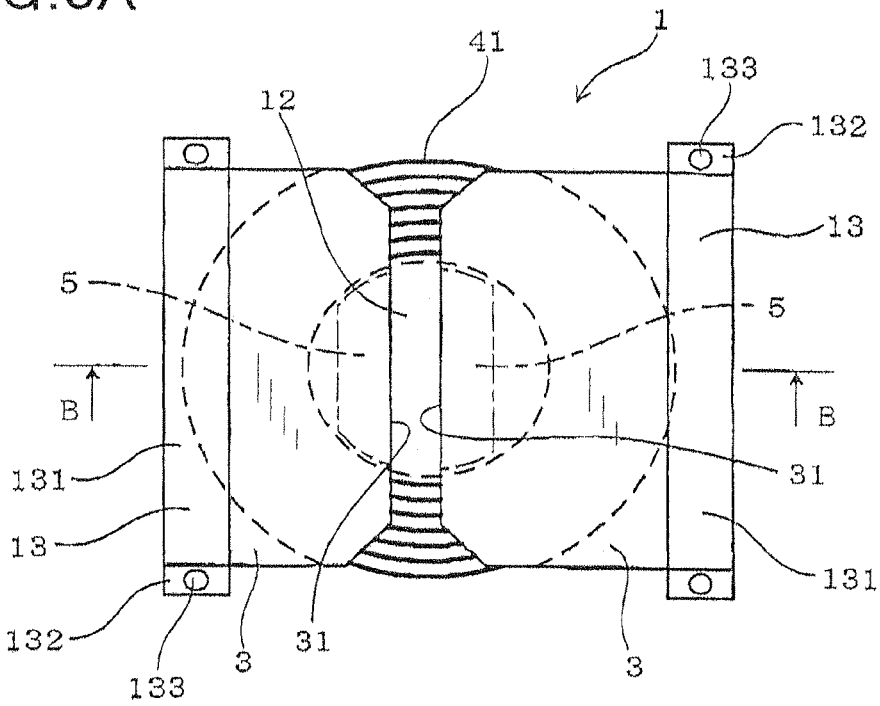
FIG. 3A is a plan view illustrating a transformer according to a first embodiment of the present invention.
Figure 3B:
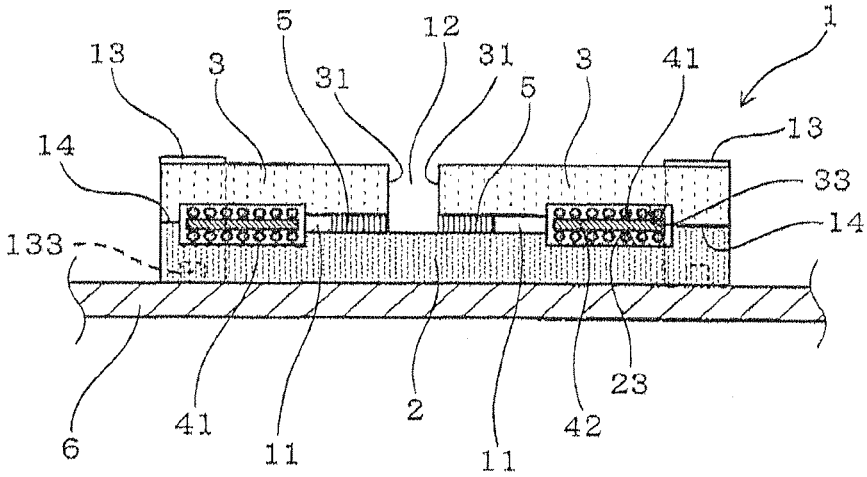
FIG. 3B is a cross-sectional view taken along a line B-B of FIG. 3A.

Referring, first, to FIGS. 3A and 3B, a transformer according to a first embodiment is described. FIG. 3A is a plan view illustrating a transformer 1 according to the first embodiment. FIG. 3B is a cross-sectional view taken along a line B-B of FIG. 3A. It should be appreciated that, throughout the embodiments, the components identical with or similar to those of the transformer based on conventional art mentioned above and shown in FIGS. 1A, 1B and 2 are given the same reference numerals for the sake of omitting unnecessary explanation.

As shown in FIGS. 3A and 3B, the transformer 1 includes a lower core 2, two upper cores 3, primary coils 41 and a secondary coil 42. The lower core 2 made of a magnetic material has an upper surface and a lower surface and is arranged on the base plate 6 through the lower surface. The two upper cores 3 made of a magnetic material are arranged face to face over the upper surface of the lower core 2. The upper surface of the lower core 2 is on the other side of the lower surface of the lower core 2, through which the lower core 2 is arranged on the base plate 6. The primary coils 41 and the secondary coil 42 are arranged between the lower core 2 and the upper cores 3. In the present specification, the normal direction of the surface (mounting surface) of the base plate 6, on which the transformer 1 is mounted, is referred to as a "vertical direction". Also, the direction in which the mounting surface is oriented is referred to as an "upper" direction and the direction opposite to the upper direction is referred to as a "lower" direction. The transformer 1 is fixed to the base plate 6.

Each of the upper cores 3 is in contact with the lower core 2 on the outer side of the primary coils 41 and the secondary coil 42. Meanwhile, a first gap 11 is formed between each upper core 3 and the lower core 2, on the inner side of the primary coils 41 and the secondary coil 42.

Further, the two upper cores 3 are extended towards each other in a direction in which the cores come close to each other, i.e. extended from the outer side of the primary coils 41 and the secondary coil 42 toward the inner side of these coils, with a second gap 12 being formed between opposing surfaces of the upper cores 3.

A spacer 5 made of a non-magnetic material is provided in each first gap 11, or each spacer 5 is interposed between the lower core 2 and each upper core 3.

The transformer 1 is incorporated into a DC-DC converter which is installed in a vehicle, for example. The DC-DC converter has a casing in which the transformer 1 is accommodated together with other electronic parts and electronic circuits. The casing is formed of non-magnetic metal, such as aluminum. The casing has a bottom plate that configures the base plate 6.

The core 2 is formed into a substantially rectangular shape as viewed from the normal direction of the base plate 6. The two cores 3 are arranged face to face over (in the upper direction of) the lower core 2. Each of the two upper cores 3 has a peripheral portion which is parallel to and in contact with a peripheral portion of the lower core 2. Specifically, the lower core 2 and each upper core 3 have a contact portion 14 between the two respective peripheral portions which are parallel to each other.

As shown in FIG. 3B, the lower core 2 is not in contact with the upper cores 3 in a portion on the inner side of the contact portion 14. The primary coils 41 and the secondary coil 42 are arranged between the lower core 2 and the upper cores 3 on the inner side of the contact portion 14. Specifically, the upper surface of the lower core 2 is formed with a recess 23 on the inner side of the contact portion 14. Further, each upper core 3 has a lower surface in which a recess 33 is formed on the inner side of the contact portion 14. The recesses 23 and 33 are opposed to each other to form a space in which the primary coils 41 and the secondary coil 42 are arranged.

Each of the primary coils 41 is formed by winding a conductor wire for a plurality of times. The conductor wire has an outer surface on which an insulating film is formed. The secondary coil 42 is formed of a metal plate having a substantially annular shape. The primary coils 41 are arranged in a state of being stacked on the upper and lower surfaces of the secondary coil 42. The primary coils 41 arranged on the upper and lower surfaces of the secondary coil 42 are connected in series.

The primary coils 41 and the secondary coil 42 are stacked in a state where each other's winding axes coincide (coaxially stacked), while being held by being wound about a bobbin, not shown, made of an insulating material.

As shown in FIGS. 3A and 3B, the transformer 1 is fixed to the base plate 6 by two holders 13. Each holder 13 is arranged over the portion including the contact portion 14 and extended downward at both ends to thereby fasten the transformer 1. Specifically, each holder 13 is obtained by bending a metal plate or the like. Each holder 13 includes a pressing portion 131 and two flange portions 132. The pressing portion 131 presses the upper surface of the upper core 3. The two flange portions 132 are fixed to the base plate 6. The two holders 13 are arranged parallel to each other, with the respective pressing portions 131 being in contact with the upper surfaces of the respective upper cores 3. In this state, each of the holders 13 is fixed to the base plate 6 through the two flange portions 132 using respective screws 133. In this way, the transformer 1 that includes the lower core 2, the two upper cores 3, the primary coils 41 and the secondary coil 42 is fixed to the base plate 6.

The two upper cores 3 have respective opposing surfaces 31 that face with each other. The opposing surfaces 31 are located in parallel, defining the second gap 12 therebetween. Also, as mentioned above, the first gaps 11 are formed between the lower core 2 and the respective two upper cores 3, on the inner side of the primary coils 41 and the secondary coils 42. The spacers 5 mentioned above are provided in the respective first gaps 11 so as to be positioned near the second gap 12, i.e. near the opposing surfaces 31 of the respective upper cores 3. The spacers 5 are in contact with the upper surface of the lower core 2, while being in contact with the lower surfaces of the respective two upper cores 3.

The spacers 5 are made of a ceramic, such as alumina, and bonded to the lower core 2 and the respective upper cores 3 using an adhesive. Each spacer 5 is arranged at a position on the inner side of the primary coils 41 and the secondary coil 42 (arranged in the interior of the bobbin) so as to extend along an edge of the upper core 3, the edge corresponding to the lower edge of the opposing surface 31. The spacer 5 may be arranged extending throughout the empty space defined on the inner side of the primary coils 41 and the secondary coil 42 (throughout the interior of the bobbin). The material forming the spacers 5 is not limited to a ceramic, such as alumina, but may be a different non-magnetic material, such as a resin.

Advantages of the first embodiment will be described below.

In the first embodiment, the transformer 1 has the first gaps 11 in which the respective spacers 5 are provided. Thus, when magnetic attractive force is caused between the upper core 3 and the lower core 2, each spacer 5 is able to prevent the upper core 3 and the lower core 2 from displacing in the direction in which the cores come close to each other. As a result, vibration of the upper cores 3 and the lower core 2 is suppressed to thereby suppress the vibration noise of the transformer 1.

Also, the spacers 5 are made of a non-magnetic material. Therefore, the spacers 5, being arranged in the respective first gaps 11, will not deteriorate the magnetic effects exerted by the first gaps 11 and thus will not affect the magnetic flux formed in the upper cores 3 and the lower core 2. In other words, the above configuration effectively suppresses the vibration of the transformer 1 without adversely affecting the magnetic flux formed in the upper cores 3 and the lower core 2.

Thus, according to the present embodiment, the transformer 1 having less vibration can be provided.

Second Embodiment

Figure 4A:
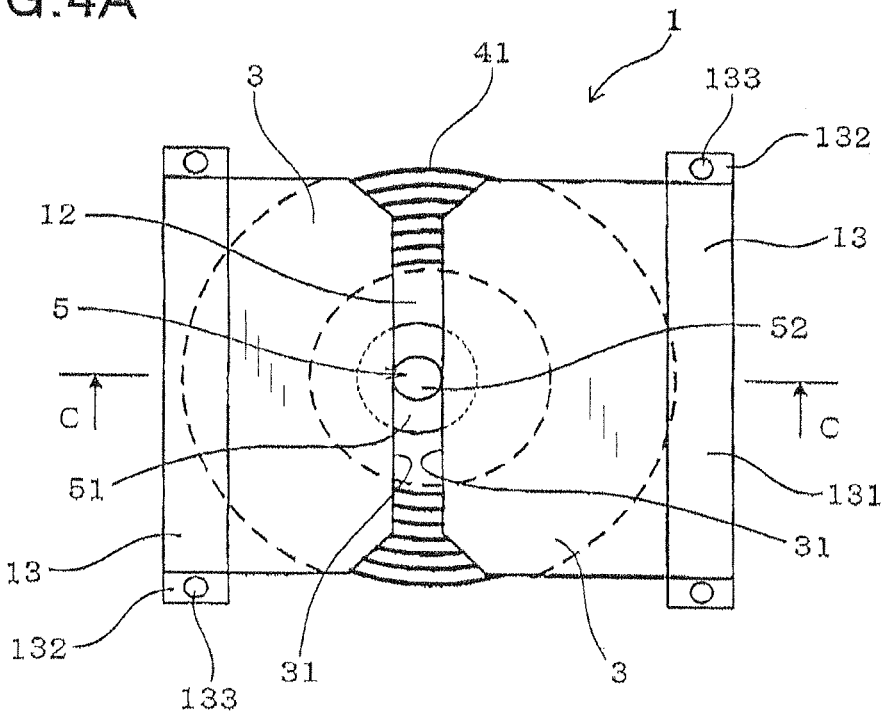
FIG. 4A is a plan view illustrating a transformer according to a second embodiment of the present embodiment.
Figure 4B:
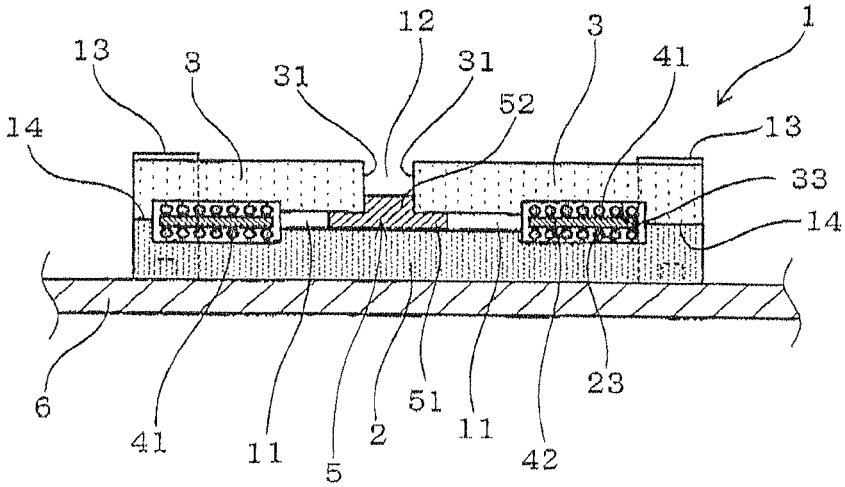
FIG. 4B is a cross sectional view taken along a line C-C of FIG. 4A.

Referring to FIGS. 4A and 4B, a second embodiment of the present invention is described. FIG. 4A is a plan view illustrating a transformer 1 according to the second embodiment. FIG. 4B is a cross-sectional view taken along a line C-C of FIG. 4A.

As shown in FIGS. 4A and 4B, the transformer 1 of the second embodiment includes a spacer 5 which is extended not only into the first gaps 11 but also into the second gap 12.

Specifically, in the second embodiment, the spacer 5 has a base portion 51 and a projected portion 52 which is projected upward from substantially the center of the base portion 51. The base portion 51 surrounding the projected portion 52 is located in the first gaps 11, while the projected portion 52 is located in the second gap 12.

The base portion 51 is formed into a disc-like shape, while the projected portion 52 is formed into a columnar shape. The base portion 51 has a lower surface contacting the upper surface of the lower core 2, and has an upper surface contacting the lower surfaces of the respective upper cores 3. The projected portion 52 has a peripheral surface contacting the opposing surfaces 31 of the respective two upper cores 3. The spacer 5 may be made of a ceramics or may be made of a resin.

The remaining configuration is similar to that of the first embodiment.

In the present embodiment, the base portion 51 of the spacer 5 is located in the first gaps 11, while the projected portion 52 thereof is located in the second 5. Accordingly, positioning of the spacer 5 is facilitated and the spacer 5 reliably and easily exerts the effect of suppressing vibration. Further, owing to the columnar shape of the projected portion 52, the direction of locating the spacer 5 is not particularly limited. Accordingly, the productivity of the transformer 1 is enhanced.

The transformer 1 of the present embodiment has other advantages similar to those of the first embodiment.

Third Embodiment

Figure 5A:
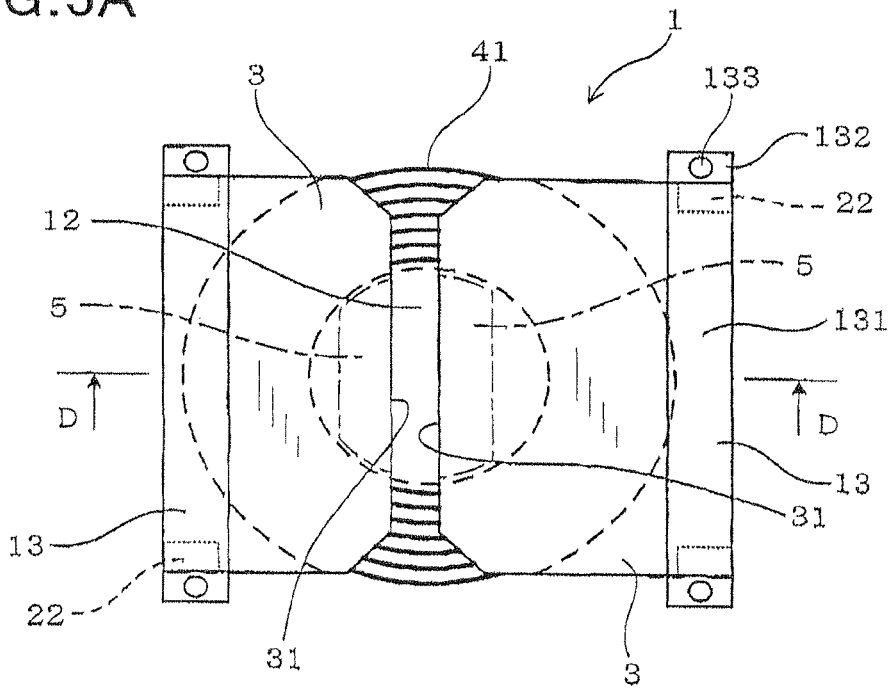
FIG. 5A is a plan view illustrating a transformer according to a third embodiment of the present invention.
Figure 5B:
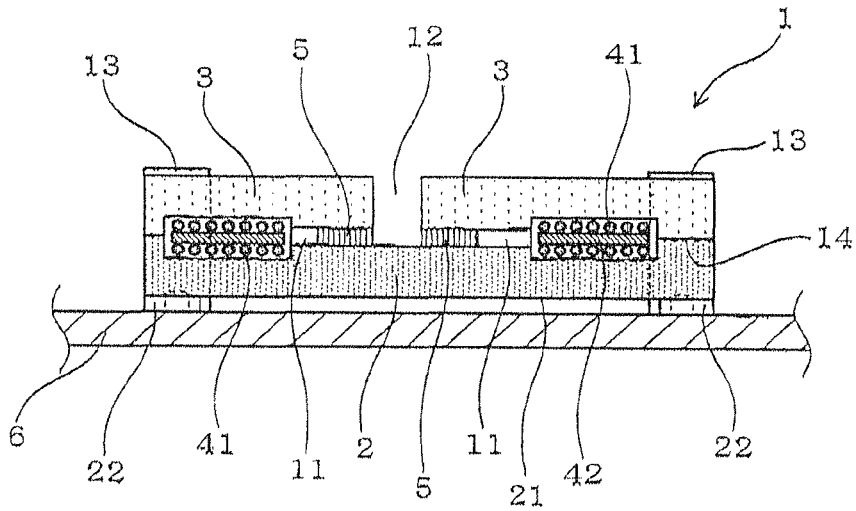
FIG. 5B is a cross sectional view taken along a line D-D of FIG. 5A.

Referring to FIGS. 5A and 5B, a third embodiment of the present invention is described. FIG. 5A is a plan view illustrating a transformer 1 of the third embodiment. FIG. 5A is a cross-sectional view taken along a line D-D of FIG. 5A.

As shown in FIGS. 5A and 5B, the transformer 1 of the third embodiment includes a lower core 2 having a non-contact surface 21 in the lower surface thereof. The non-contact surface 21 is not in contact with the base plate 6.

The non-contact surface 21 has an area that occupies not less than a half of the area of the lower surface of the lower core 2.

Specifically, the lower surface of the lower core 2 is provided with legs 22 at the respective four corners. Being provided with the legs 22, the lower surface of the lower core 2 is provided with the non-contact surface 21 not contacting the base plate 6. Also, being provided with the legs 22, a space is formed between the non-contact surface 21 of the lower core 2 and the upper surface of the base plate 6, except the portions where the legs 22 are provided.

The legs 22 may be bonded to or may not be bonded to the lower surface of the lower core 2. Alternatively, the legs 22 may be integrally formed with portions of the lower core 2.

The remaining configuration is similar to that of the first embodiment.

In the present embodiment, the legs 22 are provided at four respective corners of the lower surface of the lower core 2 to provide the non-contact surface 21 not contacting the base plate 6. With this configuration, the vibration of the transformer 1 is prevented from being transmitted via the base plate 6 to the vehicle cabin of the vehicle, for example, installing the transformer 1. Specifically, in spite of providing the spacers 5, it is sometimes difficult to completely prevent the vibration of the transformer 1. In this regard, providing the non-contact surface 21 in the lower core 2, the contact area between the transformer 1 and the base plate 6 is reduced. Accordingly, the vibration of the transformer 1 is suppressed from being transmitted to the base plate 6. For example, in a vehicle installing the transformer 1, the vibration noise is effectively suppressed from being transmitted to the vehicle cabin.

Other advantages of the present embodiment are similar to those of the first embodiment.

Fourth Embodiment

Figure 6A:
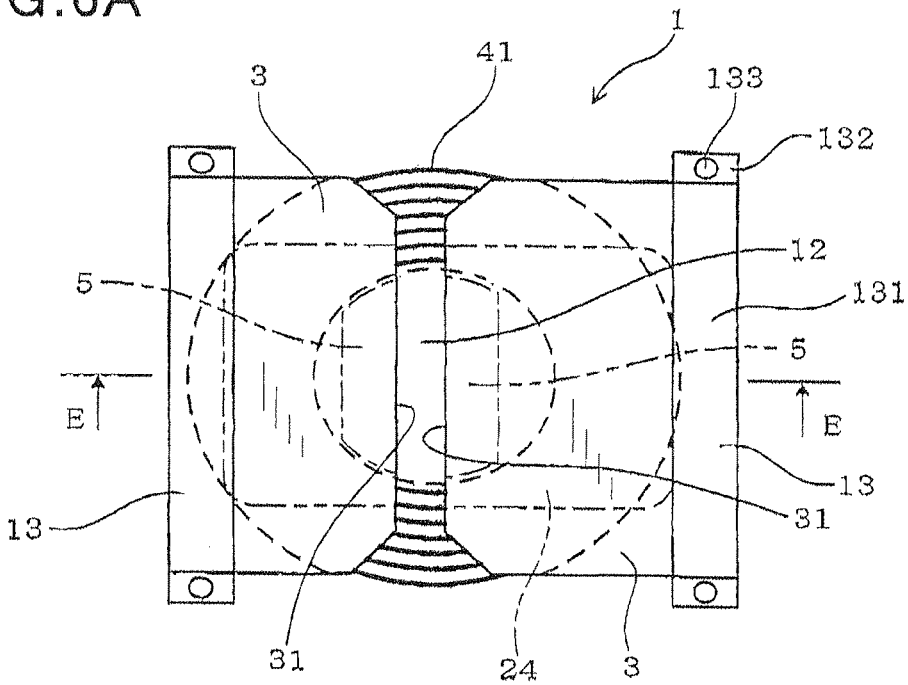
FIG. 6A is a plan view illustrating a transformer according to a fourth embodiment of the present invention.
Figure 6B:
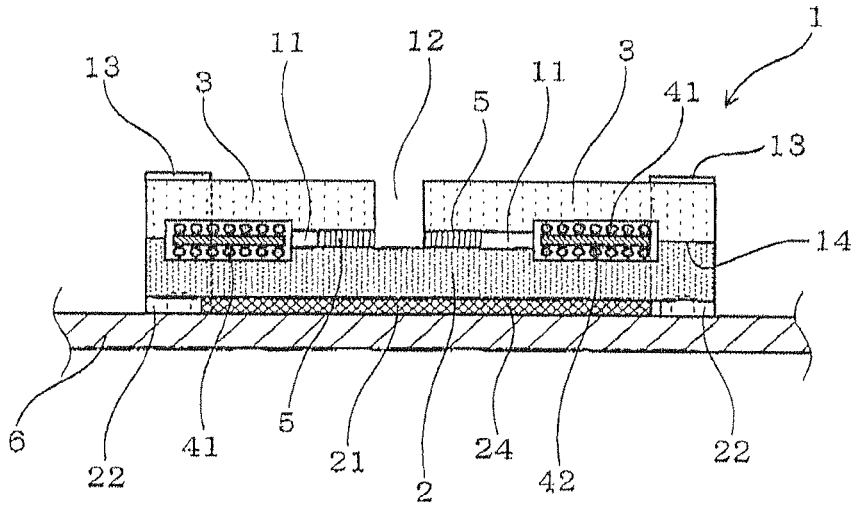
FIG. 6B is a cross sectional view taken along a line E-E of FIG. 6A.

Referring to FIGS. 6A and 6B, a fourth embodiment of the present invention is described. FIG. 6A is a plan view illustrating a transformer 1 according to the forth embodiment. FIG. 6B is a cross-sectional view taken along a line E-E of FIG. 6A.

As shown in FIGS. 6A and 6B, the transformer 1 of the fourth embodiment includes a vibration absorber 24 made of grease or the like between the lower core 2 and the base plate 6.

Specifically, the vibration absorber 24 is arranged between the non-contact surface 21 in the lower surface of the lower core 2, as provided in the above third embodiment, and the base plate 6. The vibration absorber 24 is in contact with both of the base plate 6 and the lower surface (non-contact surface 21) of the lower core 2.

The area for arranging the vibration absorber 24 occupies not less than a half of the area of the lower surface of the lower core 2.

The remaining configuration is similar to that of the third embodiment.

In the present embodiment, the vibration absorber 24 is arranged between the non-contact surface 21 in the lower surface of the lower core 2 and the base plate 6. Accordingly, the vibration absorber 24 absorbs the vibration of the lower core 2 to suppress the vibration of the lower core 2. Also, the vibration absorber 24, as it is interposed between the lower core 2 and the base plate 6, is able to suppress the vibration of the transformer 1 from being transmitted to the base plate 6. As a result, in a vehicle, for example, installing the transformer 1, the vibration noise is effectively suppressed from being transmitted to the vehicle cabin.

Other advantages are similar to those of the third embodiment.

Fifth Embodiment

Figure 7A:
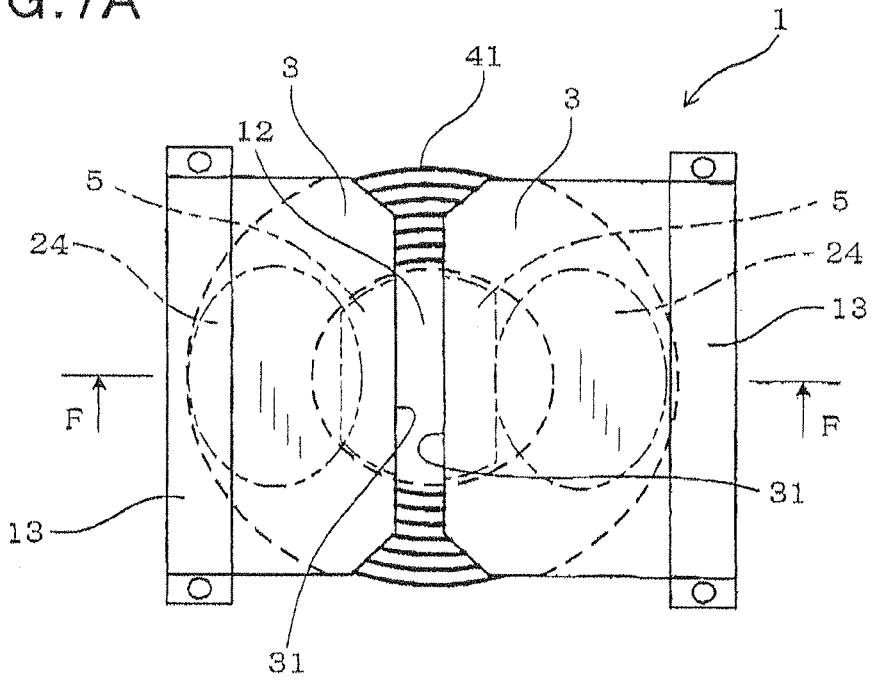
FIG. 7A is a plan view illustrating a transformer according to a fifth embodiment of the present invention.
Figure 7B:
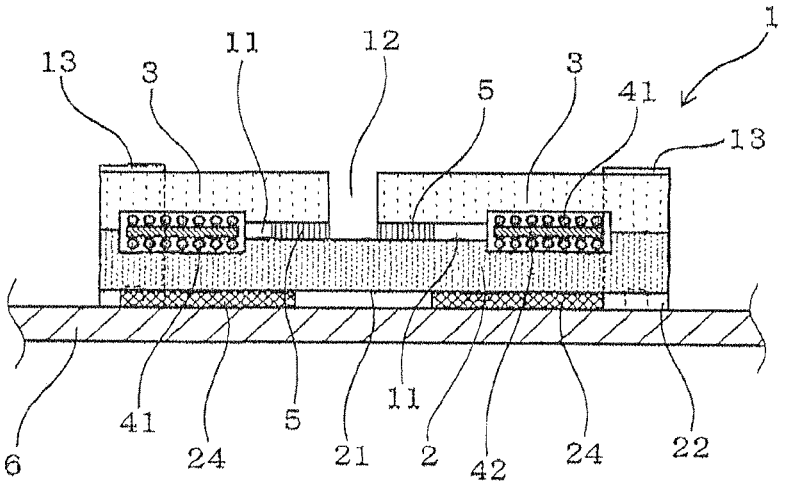
FIG. 7B is a cross sectional view taken along a line F-F of FIG. 7A.

Referring to FIGS. 7A and 7B, a fifth embodiment of the present invention is described. FIG. 7A is a plan view of a transformer 1 according to the fifth embodiment. FIG. 7B is a cross-sectional view taking along a line F-F of FIG. 7A.

As shown in FIGS. 7A and 7B, in the transformer 1 according to the fifth embodiment, two vibration absorbers 24 are arranged between the lower core 2 and the base plate 6.

Specifically, the two vibration absorbers 24 are arranged below the respective two upper cores 3. The total area for arranging the two vibration absorbers 24 occupies less than a half of the area of the lower surface of the lower core 2.

The remaining configuration is similar to that of the fourth embodiment.

In the present embodiment, two vibration absorbers 24 are and two the vibration absorbers 24 are arranged between the lower core 2 and the base plate 6. With this configuration, it may be difficult to enhance the effect of absorbing vibration compared to the transformer 1 of the fourth embodiment. However, the configuration of the present embodiment reduces the manufacturing cost of the transformer 1. Three or more vibration absorbers 24 may be arranged.

Other advantages of the present embodiment are similar to those of the fourth embodiment.

Sixth Embodiment

Figure 8A:
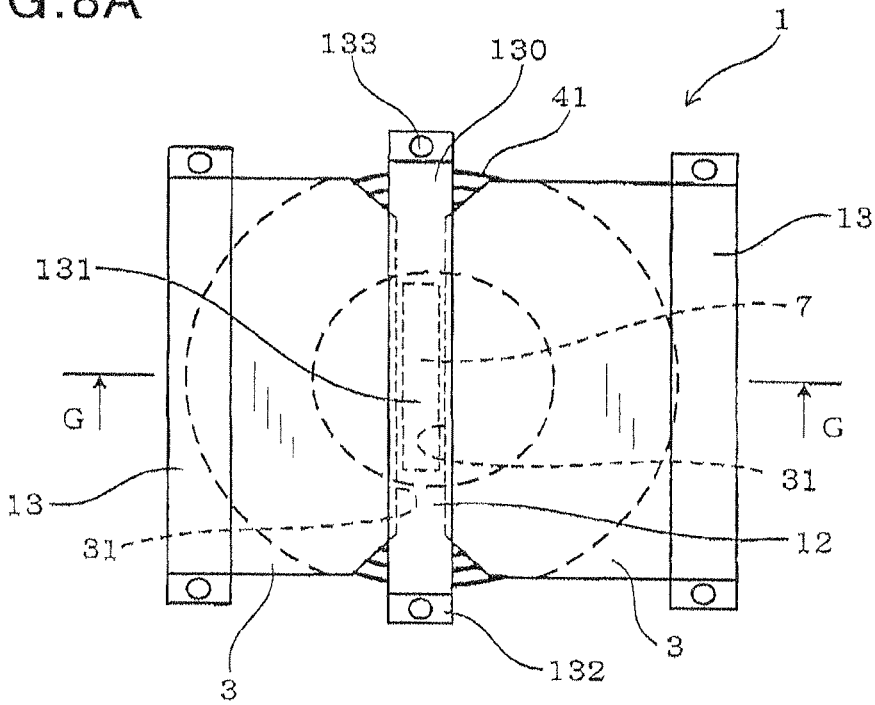
FIG. 8A is a plan view illustrating a transformer according to a sixth embodiment of the present invention.
Figure 8B:
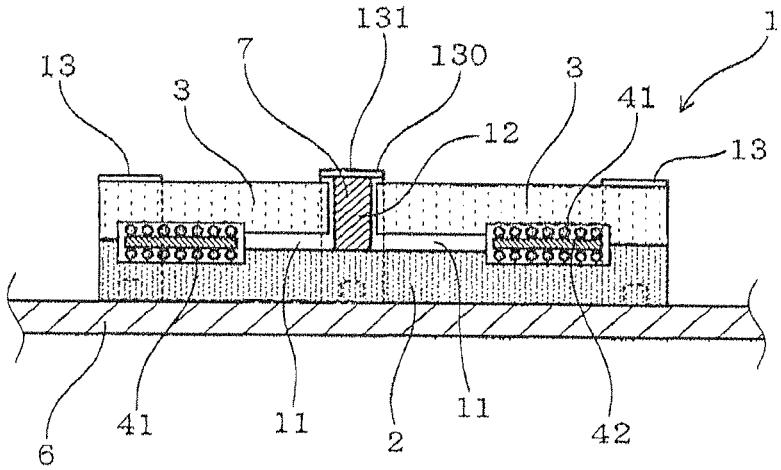
FIG. 8B is a cross sectional view taken along a line G-G of FIG. 8A.

Referring to FIGS. 8A and 8B, a sixth embodiment of the present invention is described. FIG. 8A is a plan view illustrating a transformer 1 according to the sixth embodiment. FIG. 8B is a cross-sectional view taken along a line G-G of FIG. 8A.

As shown in FIGS. 8A and 8B, the transformer 1 according to the sixth embodiment includes a pressing member 7 made of a non-magnetic material and arranged in the second gap 12. Being located in the second gap 12 on the inner side of the primary coils 41 and the secondary coil 42, the pressing member 7 presses the lower core 2 toward the base plate 6.

The pressing member 7 is held and pressed by a holder 130 from above the upper surface of the pressing member 7. The holder 130 has a structure similar to that of the holder 13 described above and thus has a pressing portion 131 and flange portions 132 similar to the holder 13. The pressing member 7 has a shape of a long rectangular parallelepiped and arranged in the second gap 12 so that the longitudinal side faces of the member 7 are substantially parallel to the respective opposing surfaces 31 of the two upper cores 3. The pressing member 7 of the present embodiment is not in contact with the opposing surfaces 31 of the two upper cores 3. However, the pressing member 7 may be in contact with the upper cores 3.

The holder 130 is arranged substantially parallel to the holders 13 that press the upper surfaces of the respective upper cores 3. The pressing portion 131 of the holder 130 is in contact with the upper surface of the pressing member 7, with the two flange portions 132 of the holder 130 being fixed to the base plate 6 via respective screws 133. In this way, the pressing force of the holder 130 is applied to the upper surface of the core 2 via the pressing member 7, allowing the lower core 2 to be pressed against the base plate 6.

The pressing member 7 may be made of a ceramic, such as alumina, or may be made of a resin.

The remaining configuration is similar to that of the first embodiment.

The transformer 1 of the present embodiment includes the pressing member 7 made of a non-magnetic material and provided in the second gap 12. Thus, being located in the second gap 12 on the inner side of the primary coils 41 and the secondary coil 42, the pressing member 7 presses the lower core 2 against the base plate 6. Thus, through the portion of the lower core 2 in communication with the second gap 12 (the portion of the core 2 below the second gap 12), the lower core 2 is locked up against the base plate 6 to thereby suppress the vibration of the lower core 2. Specifically, in portions of the first gaps 11, in particular, between the lower core 2 and the respective upper cores 3 and near the second gap 12, a large magnetic attractive force is easily caused and the amplitude of the vibration tends to be large. In this regard, using the pressing member 7, the lower core 2 is pressed against the base plate 6 in these portions to thereby suppress the vibration of the lower core 2. As a result, the vibration noise of the transformer 1 is suppressed.

Further, being made of a non-magnetic material, the pressing member 7, when it is arranged in the second gap 12, will not deteriorate the magnetic effect of the second gap 12 and thus will not adversely affect the magnetic flux formed in the upper cores 3 and the lower core 2. In other words, the configuration described above effectively suppresses the vibration of the transformer 1 without adversely affecting the magnetic flux formed in the upper cores 3 and the lower core 2.

Thus, according to the present embodiment, a transformer with suppressed vibration is provided.

Experimental Example

Figure 9:
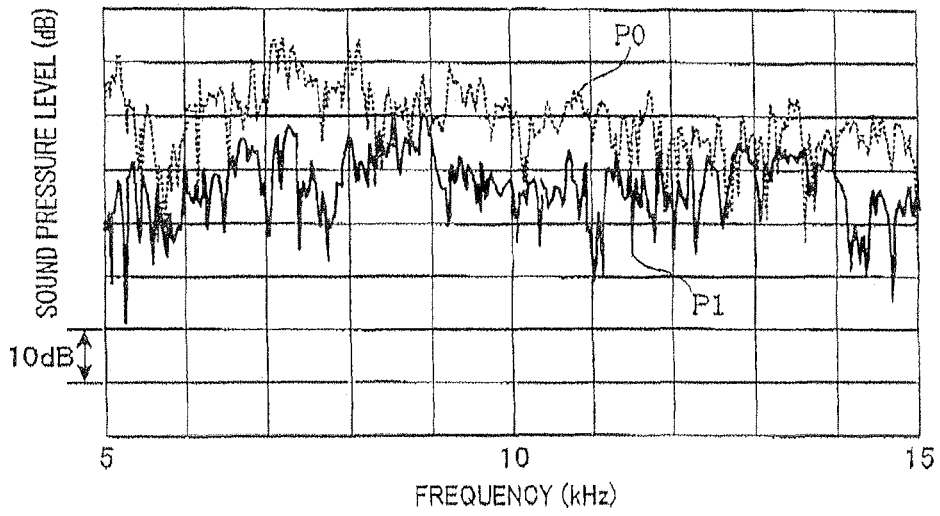
FIG. 9 is a diagram illustrating sound pressure measured in a frequency range of 5 to 15 kHz, according to an experimental example.

FIG. 9 is a diagram illustrating sound pressure measured in a frequency range of 5 to 15 kHz, according to an experimental example.

As shown in FIG. 9, in the experimental example, the sound pressure level of the vibration noise caused by the transformer 1 of the first embodiment is compared with the sound pressure level of the vibration noise caused by a transformer without being provided with the spacers 5. The "transformer without being provided with the spacers 5" in the above comparison corresponds to the "transformer 9" based on conventional art explained referring to FIGS. 1A and 1B.

In making an evaluation, the drive frequency of each transformer was gradually changed within the range of from 5 to 15 kHz, while the sound level of the vibration noise of the transformer was measured at each drive frequency. Specifically, a microphone was placed at a position 10 cm above the upper cores 3 to detect the vibration noise. Then, the sound pressure level of the caught vibration noise was measured.

The results are shown in FIG. 9. In FIG. 9, a line P1 indicates the measurement values of the sound pressure level of the transformer according to the first embodiment. A line P0 in the figure indicates the measurement values of the sound pressure level of the transformer based on conventional art.

As will be understood from FIG. 9, throughout the range of 5 to 15 kHz of the drive frequency, the sound pressure level of the transformer according to the first embodiment was lower than the sound pressure level of the transformer based on conventional art. Usually, the transformer actually used in a DC-DC converter for a vehicle has a drive frequency of around 10 kHz. Around the drive frequency of 10 kHz, the sound pressure level of the transformer according to the first embodiment is lower, by about 11 dB, than the sound pressure level of the transformer based on conventional art.

As described above, the transformer according to the first embodiment was confirmed to effectively suppress the vibration and to thereby well suppress the vibration noise.

The first to sixth embodiments described above may be adequately combined. When the embodiments are combined, the advantages of all of the combined embodiments may be enjoyed.

For example, the first embodiment and the sixth embodiment may be combined. In other words, both of the spacers 5 (FIG. 3) and the pressing member 7 (FIG. 8) may be used in a transformer. In this case, while the vibration of the lower core 2 is reliably suppressed, the relative vibration between the lower core 2 and the upper cores 3 is suppressed. Thus, the vibration of the transformer 1 is more effectively suppressed by the synergistic effect of the spacers 5 and the pressing member 7.

Also, for example, the third or fourth embodiment may be combined with the sixth embodiment. In this case as well, while the vibration of the lower core 2 is suppressed, the vibration beyond suppression of the transformer 1 is prevented from being transmitted to the base plate 6.

Different combinations of the first to sixth embodiments can also be practiced.

In the present specification, the expressions "upper" and "lower" have been used for the sake of convenience. The direction of arranging the transformer with respect to the vertical direction is not particularly limited.

What is claimed is:

1. A transformer arranged on a base plate, comprising a lower core, the lower core being made of a magnetic material, having a lower surface and an upper surface and being arranged on the base plate;

at least two upper cores including two upper cores made of a magnetic material and arranged face to face over the upper surface of the lower core, the upper surface of the lower core being on the other side of the lower surface of the lower core through which the lower core is arranged on the base plate;

a primary coil, and a secondary coil, the primary coil and the secondary coil being arranged between the lower core and the upper cores, wherein:

each of the two upper cores is in contact with the lower core, on an outer side of the primary coil and the secondary coil, with two first gaps being provided between the upper core and the lower core, on an inner side of the primary coil and the secondary coil;

the two upper cores are each extended from the outer side to the inner side of the primary coil and the secondary coil, in a direction of coming close to each other, with a second gap being provided between opposing surfaces of the two upper cores;

a spacer made of a non-magnetic material is provided in each of the two first gaps such that the spacer rigidly connects each of the upper cores and the lower core, the spacer being positioned radially inside the primary and secondary coils; and a pressing device is provided, the pressing device includes a pressing member made of a non-magnetic material and arranged in the second gap such that the pressing member presses the lower core against the base plate the pressing member being prevented from being touched with the opposing surfaces of the two upper cores.

2. The transformer according to claim 1, wherein the lower surface of the lower core, facing the base plate, includes a non-contact surface that is not in contact with the base plate.

3. The transformer according to claim 1, comprising a vibration absorber interposed between the lower core and the base plate.

4. The transformer according to claim 2, wherein the non-contact surface has an area that occupies not less than half of an area of the lower surface.

5. A transformer arranged on a base plate, comprising:

a lower core made of a magnetic material and arranged on the base plate;

at least two upper cores including two upper cores made of a magnetic material, each of the two upper cores having two end portions, ones of the two end portions of the two upper cores being fixedly arranged on the lower core and formed to produce two first gaps between the lower core and the ones of the two upper cores, respectively, the others of the two end portions of the two upper cores being opposed to each other to produce one second gap between mutually opposing surfaces of the other two end portions of the two upper cores, the one second gap communicating with the two first gaps;

a primary coil and a secondary coil, which are arranged in the two first gaps and wound there in an annular shape, the primary and secondary coils being coaxially stacked on one another;

a spacer made of a non-magnetic material and provided in each of the two first gaps such that the spacer fixedly connects the other end portion of each of the upper cores and the lower core, the spacer being positioned radially inside the primary and secondary coils in the annular shape, the one second gap being positioned between the spacers provided in the two first gaps; and a pressing device including a pressing member made of a non-magnetic material, the pressing member being arranged in the second gap such that the pressing member presses the lower core against the base plate, the pressing member being untouchable with the opposing surfaces of the other two end portions of the two upper cores.

6. The transformer according to claim 5, wherein the spacer is provided as one member having two spacer portions each functioning as the spacer and each being provided in each of the two first gaps and a remaining portion of the one member, which is other than the two spacer portions, is located in the second gap.

7. The transformer according to claim 5, comprising a vibration absorber interposed between the lower core and the base plate.

8. The transformer according to claim 7, wherein the second gap is formed to be substantially rectangular when viewed along a vertical direction of the transformer.

9. The transformer according to claim 7, wherein the spacers provided in the two first gaps have edges which run along a length of the second gap and the edge of each of the spacers is positionally agreed with an edge of the other end portion of each of the two upper cores.

10. The transformer according to claim 8, wherein the pressing member is shaped into a rectangular parallelepiped and has two sides located parallel with the opposing surfaces of the other two end portions of the two upper cores.

11. The transformer according to claim 10, wherein the pressing member is arranged on the lower core so as to stand up from the lower core through the second gap, and the pressing device includes a holder that holds the pressing member so that the pressing member presses the lower core toward the base plate.

* * * * *